US005896976A

United States Patent [19]

Jaschke

[11] Patent Number: 5,896,976

[45] Date of Patent: Apr. 27, 1999

[54] HEIGHT ADJUSTABLE YARN GUIDE FOR FALSE TWIST TEXTURING MACHINE

[75] Inventor: Klemens Jaschke, Huckeswagen, Germany

[73] Assignee: Barmag AG, Remscheid, Germany

[21] Appl. No.: 08/928,834

[22] Filed: Sep. 12, 1997

[30] Foreign Application Priority Data

Sep. 12, 1996 [DE] Germany ..... 196 37 059

[51] Int. Cl.[6] ..... D01H 13/16

[52] U.S. Cl. ..... 57/352; 57/280

[58] Field of Search ..... 57/261, 279, 280, 57/290, 284, 352

[56] References Cited

U.S. PATENT DOCUMENTS

| | | | |
|---|---|---|---|
| Re. 30,159 | 11/1979 | Kubler . | |
| 3,448,572 | 6/1969 | Meronen . | |
| 3,636,697 | 1/1972 | Treptow et al. . | |
| 3,842,578 | 10/1974 | Schippers | 57/280 |
| 3,843,868 | 10/1974 | Whittaker | 219/470 |
| 3,981,128 | 9/1976 | Munker . | |
| 4,236,323 | 12/1980 | Dammannn et al. | 57/284 |
| 4,308,716 | 1/1982 | Bauer | 57/286 |
| 4,362,011 | 12/1982 | Kikuchi | 57/291 |
| 4,565,524 | 1/1986 | Riinkel et al. | 432/59 |
| 4,719,745 | 1/1988 | Konig | 57/290 |
| 5,193,334 | 3/1993 | Dammann | 57/284 |
| 5,671,519 | 9/1997 | Naylor | 57/284 |

FOREIGN PATENT DOCUMENTS

| | | |
|---|---|---|
| 2330011 | 1/1975 | Denmark . |
| 0 429 980 | 11/1990 | European Pat. Off. . |
| 2686626 | 7/1993 | France . |
| 21 55 514 | 11/1971 | Germany . |
| 23 48 322 | 9/1973 | Germany . |
| 1269110 | 4/1972 | United Kingdom . |

*Primary Examiner*—John J. Calvert
*Assistant Examiner*—Tejash D. Patel
*Attorney, Agent, or Firm*—Alston & Bird LLP

[57] ABSTRACT

A yarn false twist texturing machine in which an advancing yarn is deflected by a feed yarn guide at a deflection position which is between a heater and a cooling member, and which is at an elevation outside the reach of the machine operator. The feed yarn guide is height adjustable, and it is disposed on a sliding element, which is movable upwards and downwards on a guide rail by means of a linear drive. In the event the electrical energy supply of the machine fails, the linear drive is activated by means of a control device in such a way that the sliding element and the yarn guide move downwardly to a predetermined parking position just below the yarn deflection position, so as to automatically remove the yarn from the heater and thereby prevent yarn damage.

20 Claims, 7 Drawing Sheets

HEIGHT ADJUSTABLE YARN GUIDE FOR FALSE TWIST TEXTURING MACHINE

BACKGROUND OF THE INVENTION

The present invention relates to a yarn false twist texturing machine with a height adjustable feed yarn guide, of the type disclosed, for example, in U.S. Pat. No. Re. 30,159 and DE-PS 23 48 322.

The latter document discloses a height adjustable hand rod with a sliding guide and a cable mechanism with guide rollers to bridge the significant operating heights and reach the apex formed between the yarn heater and the cooling member of the machine. In this case, a feed yarn guide is moved from a position which can be reached by the operator, in which the yarn is inserted into the feed yarn guide, to a feed position, the feed yarn guide bringing the yarn into its final path in the heating device by means of a pivoted lever. The mechanism is relatively complicated and calls for long operating paths with regard to the manual operation of the hand rod. In the event of the electrical energy supply of a texturing machine failing, this leads to the yarn remaining in the heater until the operator retracts the yarn guide with the yarn. However, when using high-temperature heaters in texturing machines, the danger exists that the yarn may be damaged prior to removal from the heater.

A heating device is known from EP 0 429 980 in which a height adjustable yarn guide is disposed at the exit of the heater. This yarn guide is activated in the event of the electrical energy supply failing and lifts the yarn from the contact surface of the heater. However, this facility is not suitable for bridging a working height extending beyond the range of an operator when feeding the yarn.

It is accordingly an object of the invention to provide a yarn false twist texturing machine having a height adjustable feed yarn guide, which in the event of the electrical energy supply failing, executes a swift removal of the yarn from the heater independently of the operator. The yarn is thus brought into a position which prevents damage to the yarn from prolonged contact with the heater.

SUMMARY OF THE INVENTION

The above and other objects and advantages of the invention are achieved by the provision of a yarn guide apparatus which comprises a yarn guide, and a guide rail mounting said yarn guide for linear movement between an upper position and a lower position. A drive is provided for selectively moving the yarn guide between the upper and lower positions, and a control is provided for, upon the occurrence of a sensed condition while the yarn guide is in its upper position, moving the yarn guide downwardly from the upper position to a parking position located just below the upper position and holding the yarn guide at the parking position.

The control preferably includes a blocking member mounted for movement between an inactive position wherein the yarn guide is free to move between the upper and lower positions, and a blocking position wherein the blocking member is adapted to engage and hold the yarn guide at the parking position. Also, the control includes a control device for simultaneously moving the blocking member from the inactive position to the blocking position, and moving the yarn guide downwardly to the parking position where it is engaged by the blocking member, upon a power failure or similar sensed external condition.

The yarn guide is accordingly moved by means of an automatic drive. The drive is linear and is activated in the event of the electrical energy supply failing by the control such that the yarn guide pauses on its downward travel for the purpose of a premature stop in a predetermined parking position just underneath the upper yarn deflection position. One particular advantage of the invention lies in the fact that the yarn can be removed from the heating device simultaneously at each operating station. Furthermore, the yarn is brought into a position in which neither an impermissible slackening nor even overstretching occurs.

The yarn guide can be held in the parking position by activating the linear drive. Thus no further means are required for arresting the yarn guide.

The invention also has the advantage that the yarn can be re-inserted into the heating device without delay on restart of the machine due to the yarn guide being moved by the linear drive.

According to an advantageous development of the texturing machine, a braking device is disposed on the guide rail just below the upper yarn deflection position, which facilitates a premature stop of the feed yarn guide in a predetermined parking position. Here the linear drive of the yarn guide and the braking device are only activated if the yarn is not transported or the electrical energy supply of the texturing machine has failed. In this case the parking position is chosen in such a manner that no damage occurs to the yarn following the downward travel of the yarn guide with the yarn. The particular advantage in this case is that the yarn guide is triggerable only by a pulse.

The braking device is preferably executed with a mechanically actuatable blocking member, which in particular guarantees a high functional reliability. Here the blocking member is adjustable between a free-running inactive position for the free travel of the yarn guide and a blocking position for stopping the yarn guide.

In a preferred embodiment, the guide rail comprises a tubular sleeve, and the drive for moving the yarn guide includes a piston slidably mounted in the sleeve and to which the yarn guide is secured by magnetic means. A valve is provided for selectively directing compressed air into the sleeve on either side of the piston. Also, to trigger the adjustment of the blocking member it is advantageous if a force provider pivots the blocking member into the path of the yarn guide.

A spring may be provided which exerts a force on the blocking member in a direction toward the free-running inactive position. This development has the advantage that when the force provider is not activated, the blocking member is pivoted automatically back into the free-running position.

The force provider preferably comprises a cylinder piston unit, which is actuated pneumatically. According to a further preferred practical example, the blocking member is movable into a waiting position, in which the blocking member is fixed automatically with a catch, the blocking member protruding partly into the path of the yarn guide. This execution is particularly advantageous if the force provider can only be activated in a pulsed manner.

A further development envisages that the adjustment of the blocking member from the waiting position to the parking position leads to an unblocking of the catch. Here the linear drive triggered by a pulse with the sliding element travelling downwards can be used advantageously to adjust the blocking member.

According to a further advantageous development, the blocking member of the braking device takes the form of a ratchet supported in a pivot joint. Here the ratchet has a recess, in which an undercut of the adjusting piston of the cylinder piston unit engages when the waiting position is reached. This execution has the advantage that no additional means are required to realize a catch.

BRIEF DESCRIPTION OF THE DRAWINGS

Some of the objects and advantages of the present invention having been stated, others will appear as the description proceeds, when considered in conjunction with the accompanying drawings, in which.

DETAILED DESCRIPTION OF THE PREFERRED EMBODIMENT

Figure 1:
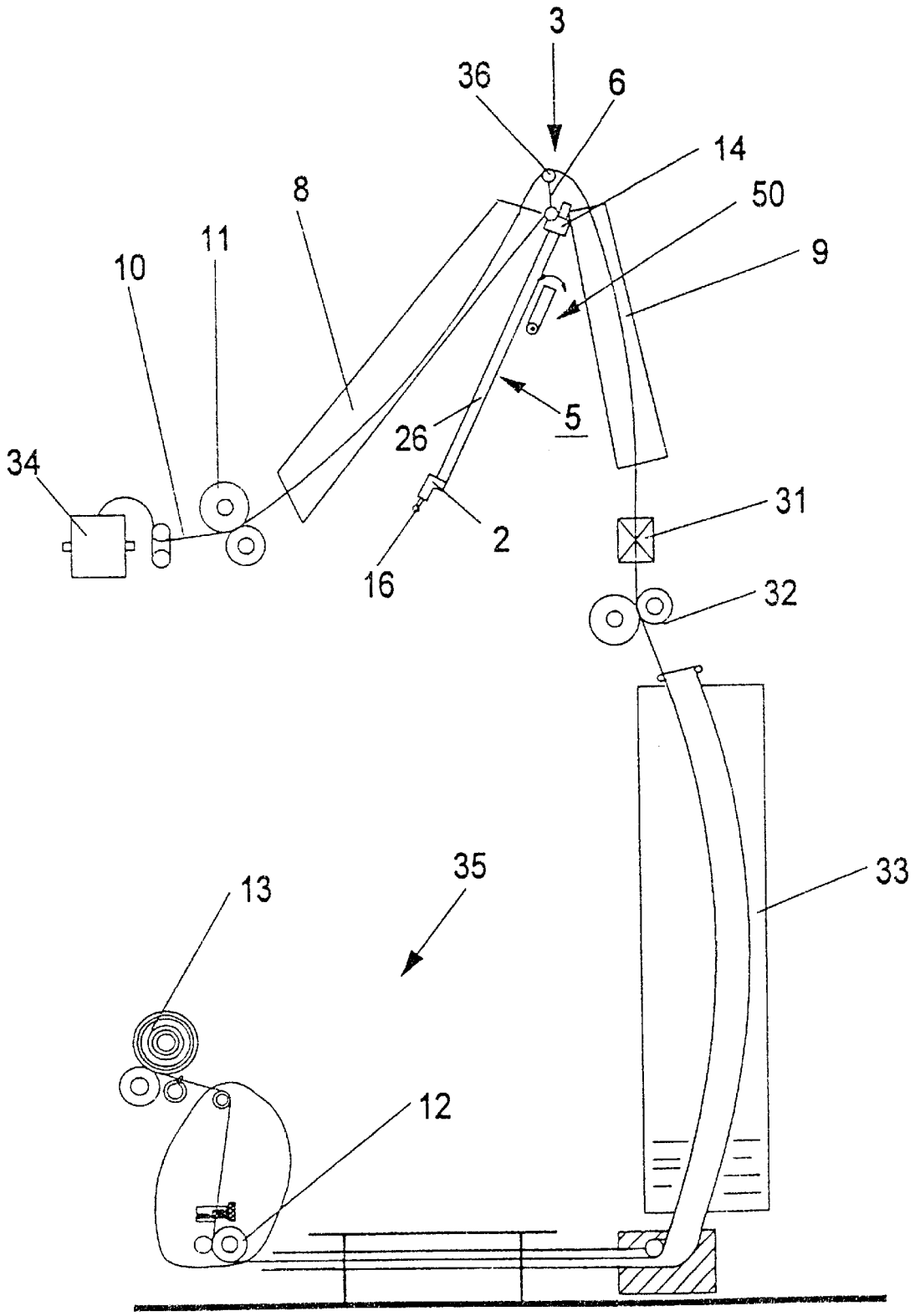
FIG. 1 shows the basic structure of a yarn false twist texturing machine in combination with the feed yarn guide of the present invention.

FIG. 1 shows the basic structure of a texturing machine, in which at each corresponding operating position the yarn 10 is supplied from the feed bobbin 34 via a delivery unit 11, which consists of appropriate transport rollers, to a heating device 8. At the end of the heating device 8 is a feed yarn guide 6 with a deflection roller 36, over which the yarn 10 runs and is deflected, so that it enters a cooling device 9 afterwards. From the cooling device the yarn 10 is supplied to a false twister 31 and a take-off unit 12, from where it is supplied to a wind-up facility 13. In the illustrated embodiment, the yarn 10 is led through a further heater 33 prior to the delivery unit 12. Disposed between the heater 33 and the false twister 31 is the delivery unit 32. In the upper part of the texturing machine between the heater 8 and the cooling device 9 above the operating aisle 35, the linear drive 5 of the feed yarn guide 6 is shown. The linear drive 5 includes the longitudinal guide rail 26, which is formed as a sleeve, which has a connection plug for compressed air on one side and which on its other side, i.e. the lower side in FIG. 1, has a control valve 2 actuatable by means of a plunger 16. The sliding element 14 carried on the outside of the sleeve 26, to which element the feed yarn guide 6 is pivotably fastened, is shown in FIG. 1 in the topmost position of the deflection position 3.

The linear drive 5 comprises, for example, a pneumatic drive. In principle the linear drive for moving the sliding element 14 can also be realized by electrical, electromechanical or even hydraulic means.

The insertion of the yarn into the final heating position is effected here by swivelling the feed yarn guide 6, the feed yarn guide 6 striking a curved limit stop (not shown here) with its swivel arm and being swivelled.

The topmost position corresponds to the position in which the control valve 2 has supplied compressed air from a compressed air source to the underside of a magnetic piston 7 (cf. FIG. 4) until the latter in the sleeve is in its topmost position in the limit stop with the inlet plug 24 or in an external limit stop. On the guide rail 26 a braking device 50 is disposed just underneath the deflection position 3. The braking device 50 is located in a free-running or inactive position, so that the sliding element 14 is freely movable on the guide rail 26.

The basic structure of a texturing machine shown in FIG. 1 was selected as an example. The invention covers arrangements as well in which a heating device and a cooling member are disposed in a common inclined position with an ascent to the deflection position. An arrangement is also possible in which in the arrangement from FIG. 1 the cooling member 9 has a second heating device disposed before it in the yarn path. Here the deflection position is situated between a first heating zone and a second heating zone. The heating device 33 after the delivery unit 32 is provided here only in cases in which the yarn has to receive a thermal post-treatment in a set zone.

Figure 2:
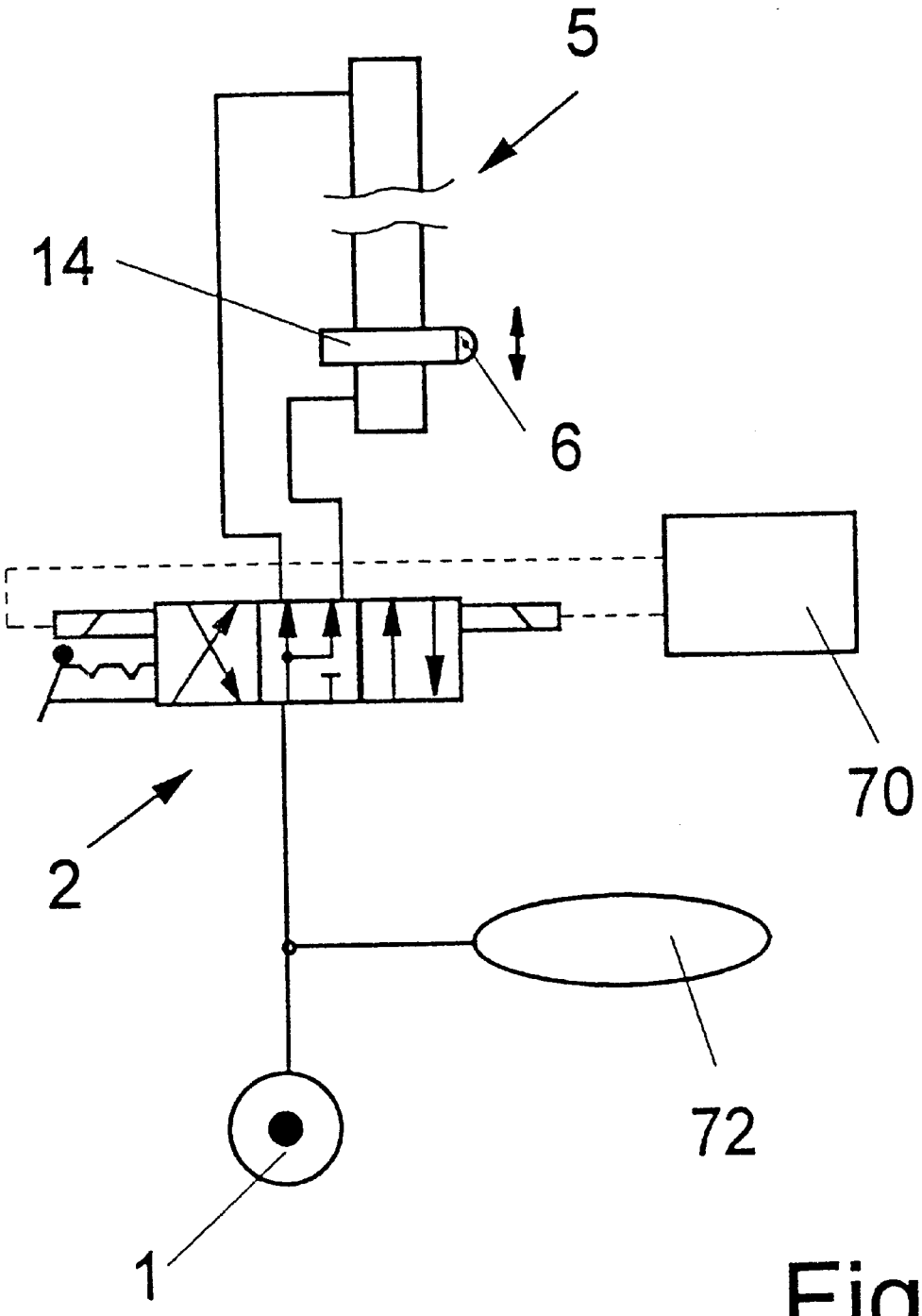
FIG. 2 shows a circuit diagram of a linear drive for moving the feed yarn guide.

In FIG. 2, a circuit diagram is shown of a basic arrangement of a practical example of the invention without a braking device. A compressed air source 1 is connected via a control valve 2 to a linear drive 5. The linear drive 5 has a sleeve, in which a magnetic piston can be moved up and down without a piston rod by the action of pressure. Fastened slidingly as a magnet on the outside of the sleeve is a sliding element 14, which has a polarity which is different to that of the magnetic piston on the inside of the sleeve. The magnet or sliding element 14 fastened on the outer circumference of the sleeve is moved up and down thereby when pressure acts on the magnetic piston in the inside of the sleeve. Disposed on the sliding element 14 is the feed yarn guide 6, by means of which the yarn can be inserted into the heating device 8 or the cooling device 9. The control valve 2 is switched manually by an operator. In addition, the control valve 2 is triggerable via a control device 70. The control device 70 serves in the event of the electrical energy of the texturing machine failing to connect the compressed air source 1 to the linear drive 5 in such a way that the piston is first moved downwards in a pulse time predetermined by the control device 70 in order then to pause in a parking position at a middle position of the control valve 2. The compressed air supply is secured here via a pressure store 72.

Figure 3:
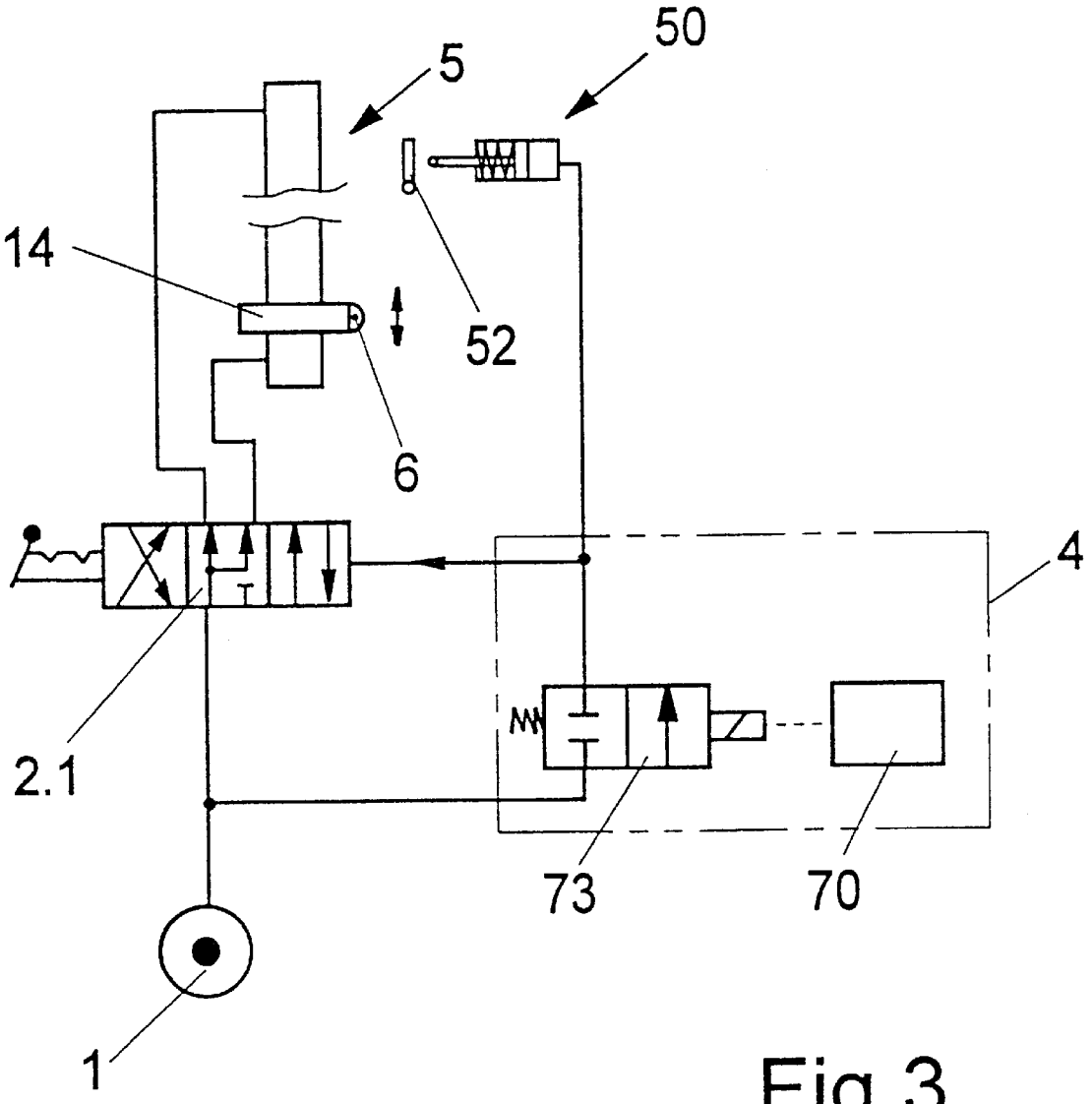
FIG. 3 shows a circuit diagram of a linear drive with a braking device.

FIG. 3 shows the linear drive 5 from FIG. 2, the linear drive being triggered by a control valve 2.1. Compared with the embodiment in FIG. 2, the control valve 2.1 is triggered here by a pilot valve 73 in the event of a power failure. The pilot valve 73 is activated for this purpose via the control device 70. At the same time as the pilot valve 73 is switched over, the braking device 50 is activated, so that a blocking member 52 engages in the path of the sliding element 14. The control valve 2.1 is brought by the triggering by the pilot valve 73 into its right switching position, so that the magnetic piston of the linear drive 5 is acted upon in such a manner that the sliding element 14 moves downwards. However, due to the activation of the braking device 50 the sliding element 14 is held in a preset parking position.

Figure 4:
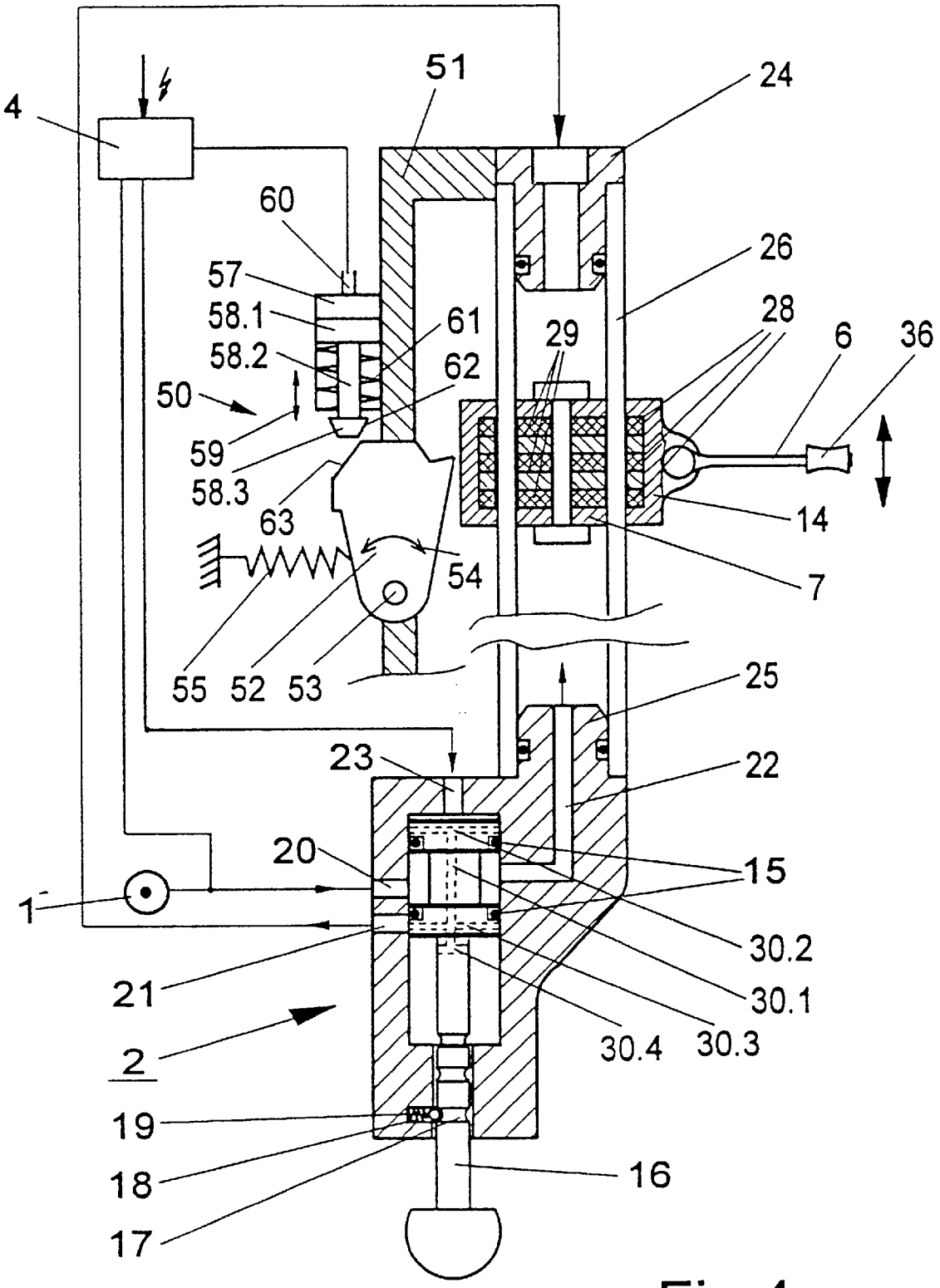
FIG. 4 shows a pneumatically controlled feed yarn guide with a braking device.

FIG. 4 shows the linear drive 5 of the feed yarn guide with a braking device 50. Provided at the control valve 2 is a compressed air source 1, via which compressed air is supplied to the control valve. Depending on the position of a double piston 15 which is formed, a supply line is led from this control valve to the underside of a magnetic piston 7 without a piston rod or to the upper side of this magnetic piston 7, which is guided in a cylindrically formed guide rail (sleeve) 26. In opposing polarity to the polarity of the magnet of the magnetic piston 7, a sliding element 14 with magnets is located slidably on the outer circumference of the sleeve 26, attached pivotably to which element is the actual feed yarn guide 6 with deflection roller 36. The magnetic piston 7 has several annular magnets 29 arranged parallel to one another. In contrast, the annular magnets 28 are disposed in the sliding element 14 on the outer sheath. Provided in the valve 2 is a compressed air connection 20 for connecting the compressed air source 1 to the control valve, a compressed air connection 21 for connecting the control valve 2 to the upper side of the magnetic piston 7 via a compressed air connection piece 24 on the top of the sleeve 26 for acting on the upper side of the magnetic piston, a compressed air connection 22 for acting on the magnetic piston 7 from the underside and a compressed air connection 23 for automatically retracting the yarn guide, i.e. for removing the yarn from the heating device 8 or cooling device 9. The double piston 15 of the control valve 2 is connected to a plunger 16 which has a manually engageable handle located outside the housing of the valve 2. Between the double piston 15 and the handle, three catch grooves 17 are formed in the plunger, which grooves correspond to the respective catch positions of the yarn guide 6. Located in the housing of the control valve 2 is a ball 18 acted on by a spring 19, which ball engages in a catch groove 17 corresponding to the respective catch position and thus locks this respective catch position. The first catch position shown in FIG. 4 corresponds to the position in which the compressed air from the compressed air source 1 acts via the compressed air connection 20 and compressed air connection 22 on the underside of the magnetic piston 7, whereby the piston 7 is extended i.e. moved from bottom to top. The compressed air connection 21 is connected to the deaeration duct 30 of the double piston, so that the upper side of the magnetic piston 7 is relieved. If the compressed air supply is maintained for long enough, the magnetic piston 7 is moved to the top as far as a limit stop. On account of the different polarity of the annular magnets of the magnetic piston 7 in the interior of the sleeve 26 and of the sliding annular magnets 28 on its exterior, the feed yarn guide 6 is thus moved synchronously to the movement of the magnetic piston 7.

A second and third catch position can be set by manually actuating the plunger 16. In the second catch position, the piston is acted upon from the top and bottom by compressed air, so that the feed yarn guide 6 pauses in its momentary position. The third catch position of the plunger causes the magnetic piston 7 to be moved downwards and thus the sliding element 14 with the feed yarn guide 6 is moved downwards on the sleeve.

The sleeve 26 is connected to a bracket 51. Fastened to the bracket 51 is a braking device 50. The braking device 50 consists of a ratchet or blocking member 52, which is pivotally connected at its one end to the bracket 51 in a swivel joint 53. The ratchet 52 is held in the position shown in FIG. 4 (free-running position) by means of a spring 55. For this purpose the spring 55 is disposed between the bracket 51 and the ratchet 52. The ratchet 52 is swivellable in the direction of movement 54. Furthermore, the braking device has a cylinder piston unit 57. The cylinder piston unit is capable of being acted upon via a pressure connection 60 by a pressure medium, preferably compressed air. The piston 58 has a piston shaft 58.1, which is guided in the cylinder. Fastened on the cylinder shaft 58.1 is the piston rod 58.2. The piston rod 58.2, which emerges from the cylinder, has a piston cap 58.3 at the opposite end. Formed between the piston shaft 58.1 and the piston cap 58.3 is an undercut 64. The piston cap 58.3 is executed conically with the cone 62. The cone 62 is formed here in such a manner that when the piston is extended, i.e. in the event of pressure loading of the piston it slides with a facet 63 along the ratchet 52. Disposed between the piston shaft 58.1 and the cylinder in the intermediate space to the piston rod 58.2 is a spring 61, so that the piston has to extend against the direction of force of the spring 61. The cylinder piston unit 57 is connected to a control device 4. The control device 4 is also connected to the pressure source 1 and the control valve 2 via the pressure connection 23. As shown in FIG. 3, the control device 4 has the pilot valve 73 and the control device 70.

Description of the Method of Operation

Figure 5:
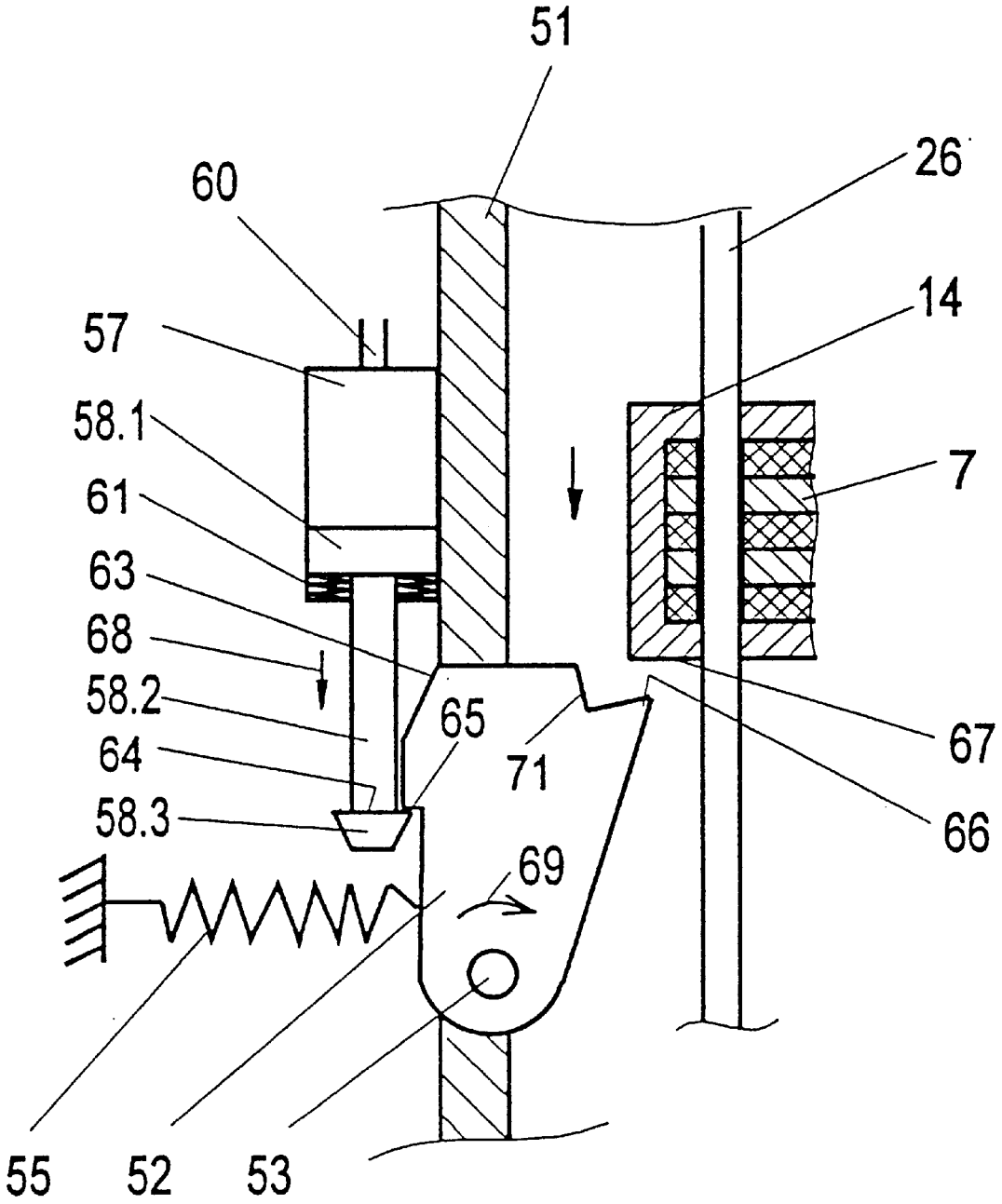
FIG. 5 shows the braking device in FIG. 4 in a waiting position.

FIG. 4 depicts the situation in which the braking device is not activated. The ratchet 52 is held in its free-running position by means of the spring 55. The sliding element 14 with the feed yarn guide 6 can be moved unhindered on the guide rail 26. In the event that the texturing machine fails owing to a power interruption, or the yarn comes to a stop in the texturing machine, a control pulse is triggered by means of the control device 4. Owing to the control pulse the cylinder piston unit 57 is acted upon for a short time by compressed air from the compressed air source. Here the piston 58 moves in the direction of movement 68 (see FIG. 5). During the extending movement of the piston the cone 62 and the facet 63 abut one another, so that with the continuing movement of the piston 58 the ratchet 52 is swivelled in the swivelling direction 69. The piston 58 is extended so far until the recess 65 of the ratchet engages in the undercut 64 of the piston. The ratchet 52 is now in a waiting position, protruding with its stop 66 into the path of the sliding element 14.

As shown in FIG. 4, the control device 4 is connected to the pressure connection 23 of the control valve 2. In the event of a power failure, the control device 4 connects the pressure connection 23 likewise to the pressure source 1. Due to this the purpose is achieved that the double piston 15 is displaced into the switching position which effects downward travel of the sliding element 14.

Figure 6:
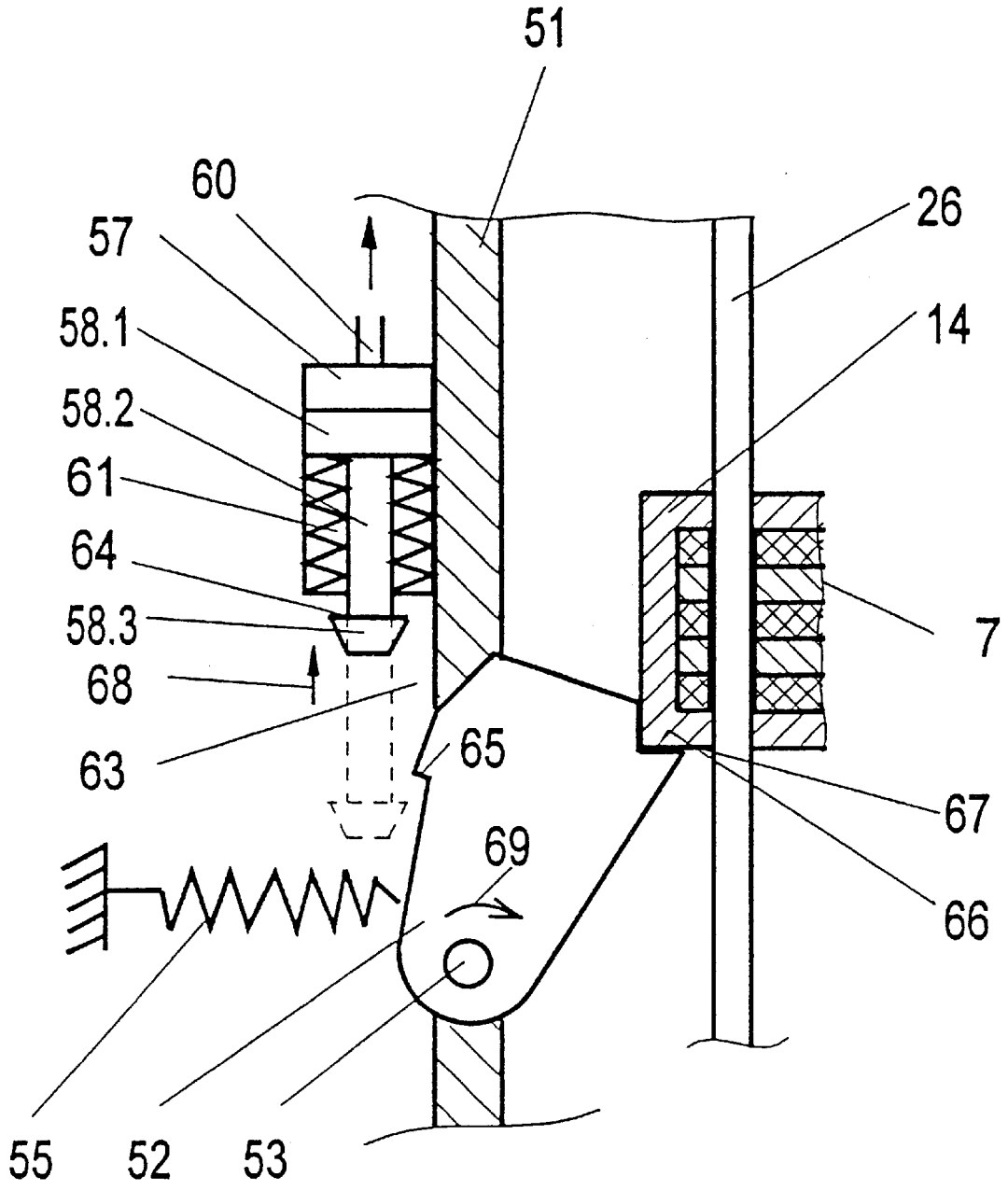
FIG. 6 shows the braking device in FIG. 4 in the parking position.

The sliding element 14 strikes the stop 66 of the ratchet 52 with its stop face 67. When the sliding element 14 meets the ratchet 52, the ratchet 52 is displaced owing to the downward movement of the sliding element 14 further in the swivelling direction 69 until the shoulder 71 of the ratchet 52 mounted on the stop 66 pushes against the sliding element 14. In this position (parking position)—as shown in FIG. 6—the sliding element 14 comes to a stop. At the same time, the further swivelling of the ratchet 52 in direction 69 swivels the recess 65 out of the engaging area of the undercut 64 of the piston 58. The catch position of the piston 58 is thus released and the piston 58 is returned by the spring 61 to its original position in the direction 68.

If the machine is restarted or the energy supply is restored, the magnetic piston 7 is moved into the feed position by triggering of the control valve 2 and moves the sliding element 14 out of the parking position once again. As soon as the sliding element 14 is displaced out of the stop 66, the ratchet 52 is swivelled by means of the spring 55 back into its starting position (free-running position). The sliding element is thus freely movable once again on the guide rail 26.

Figure 7:
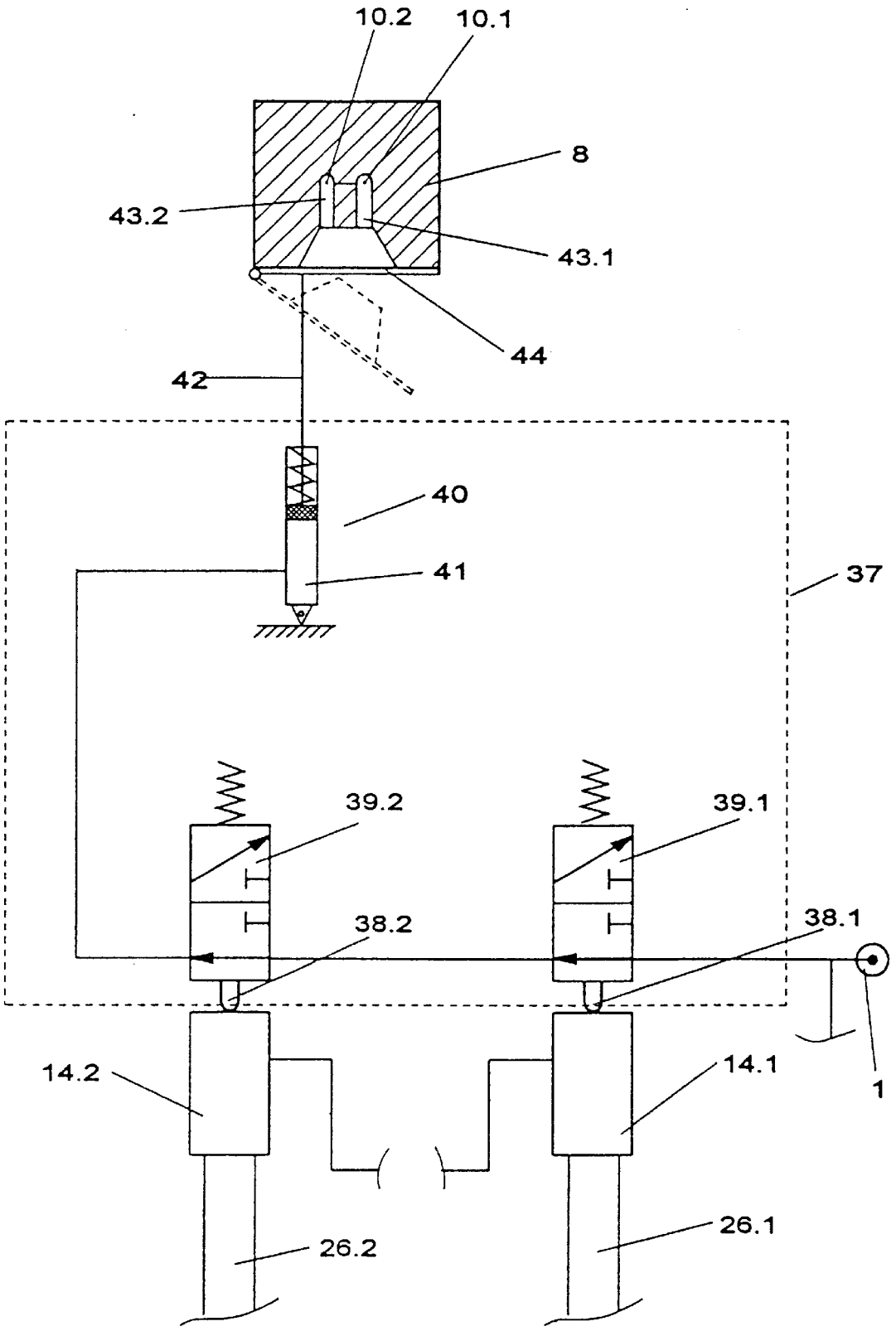
FIG. 7 shows two feed yarn guides, which operate a heating device in the extended state.

The braking device is activated jointly with the linear drive of the feed yarn guide preferably in the event of power interruptions of the texturing machine. However, it is also possible to actuate the braking device in servicing work on the machine, so that the stationary yarn can be removed as quickly as possible from the heater. As soon as the sliding element abuts the braking device during servicing, the linear drive of the feed yarn guide can be turned off. Here it is advantageous if the actuation of the heating flap of a heater is controlled by the movement of the sliding element. FIG. 7 shows a practical example of this, in which the feed yarn guide abuts an upper stop with its sliding element 14.

The stop is formed here by a contact switch 38.1 or 38.2. The contact switch is connected to a control device 37. The control device 37 consists of a control valve 39.1 and 39.2 and a closing cylinder 40. In the position shown, each control valve 39.1 and 39.2 is displaced by means of the contact switch into its left switching position. Each contact switch receives its switching pulse from the associated sliding element 14.1 or 14.2. In the left switching position of each control valve, which are shown as a 3/2-way valves, the compressed air source 1 is connected to the pressure space 41 of the closing cylinder 40. The closing cylinder 40 is connected by means of its piston rod 42 to the heating flap or cover 44 of the heating device 8. When pressure acts on the pressure space 41, the piston extends and thus closes the heating flap 44. In the embodiment shown, the heating device 8 has two heating ducts 43.1 and 43.2, and a yarn 10 is carried in each heating duct. The control device 37 in this case has two control valves 39.1 and 39.2, each triggered by a contact switch 38.1 and 38.2. Each contact switch forms the stop for the respective yarn guides of the yarns 10.1 and 10.2. In this arrangement the heating flap 44 is only closed in the event that both yarn guides or sliding elements 14.1 and 14.2 are at their stop. As soon as a sliding element or yarn guide moves away from the stop, the control valve is switched to its right switching position. In this switching position the pressure space 41 of the closing cylinder 40 is deaerated, so that the heating flap 44 of the heating device 8 is opened or remains open. The yarn can thus be removed.

In the drawings and specification, there has been set forth a preferred embodiment of the invention, and although specific terms are employed, they are used in a generic and descriptive sense only and not for purposes of limitation.

That which is claimed is:

1. An apparatus for feeding an advancing yarn to an elevated yarn deflection position and then guiding the advancing yarn at such position, comprising a guide rail having a yarn guide which moves along said guide rail between said elevated yarn deflection position and a lower thread-up position, a drive for selectively moving the yarn guide between the elevated and lower positions, and a control device for, upon the occurrence of a sensed condition while the yarn guide is in its elevated position, moving the yarn guide downwardly from the elevated position to a parking position located between the elevated and lower positions, and holding the yarn guide at the parking position.

2. The apparatus as defined in claim 1 wherein the guide rail comprises a tubular sleeve, wherein the drive includes a drive piston slidably mounted in the sleeve, and an air control valve for selectively directing compressed air into the sleeve on either side of the drive piston, and wherein said yarn guide includes a sliding element which is mounted on the outside of said sleeve and which is operatively joined to the drive piston by magnetic means so as to move with the piston.

3. The apparatus as defined in claim 2 wherein said control device is programmed so as to activate the control valve to hold the piston and the yarn guide in said parking position.

4. An apparatus for feeding an advancing yarn to an elevated yarn deflection position and then guiding the advancing yarn at such position, comprising a guide rail having a yarn guide which moves along said guide rail between said elevated yarn deflection position and a lower thread-up position, a drive for selectively moving the yarn guide between the elevated and lower positions, a blocking member mounted for movement between an inactive position wherein the yarn guide is free to move between the elevated and lower positions, and a blocking position wherein the blocking member is adapted to engage and hold the yarn guide at a parking position which is located between the elevated and lower positions, means for biasing the blocking member toward the inactive position, and a control device for, upon the occurrence of a sensed condition while the yarn guide is in its elevated position, (a) moving the blocking member from the inactive position to the blocking position, and (b) moving the yarn guide downwardly from the elevated position toward the lower position and such that the yarn guide is engaged and held at the parking position by the blocking member.

5. The yarn guiding apparatus as defined in claim 4 wherein said control device includes a cylinder piston unit having a piston rod which is extendable and retractable and which is positioned to physically contact the blocking member and move the blocking member toward the blocking position upon being extended.

6. The yarn guiding apparatus as defined in claim 5 wherein the piston rod and the blocking member includes a catch which is engaged when the piston rod is extended so as to support the blocking member in an intermediate waiting position wherein the blocking member partly protrudes into the path of the yarn guide.

7. The yarn guiding apparatus as defined in claim 6 wherein the blocking member includes a stop surface positioned to be engaged by the yarn guide when the yarn moves from the upper position downwardly and the blocking member is in said waiting position, and such that the interengagement between the blocking member and the moving yarn guide causes the blocking member to further move from said waiting position to said blocking position.

8. The yarn guiding apparatus as defined in claim 4 wherein said blocking member is mounted for pivotal movement about a pivot axis between said inactive and blocking positions.

9. The yarn guiding apparatus as defined in claim 4 wherein the guide rail comprises a tubular sleeve, wherein the drive includes a drive piston slidably mounted in the sleeve, and an air control valve for selectively directing compressed air into the sleeve on either side of the drive piston, and wherein said yarn guide includes a sliding element which is mounted on the outside of said sleeve and which is operatively joined to the drive piston by magnetic means so as to move with the piston.

10. The yarn guiding apparatus as defined in claim 9 wherein said air control valve includes a housing slidably supporting a control piston therein, and a plunger which is fixed to said control piston and extends to a location outside of said housing so as to be manually engageable.

11. A yarn false twist texturing apparatus comprising an elongate yarn heater which includes a yarn inlet end and a yarn outlet end, an elongate yarn cooling member which includes an inlet end and an outlet end, a yarn false twisting device, a winder for winding an advancing yarn into a package, means for advancing a yarn serially to said heater, said cooling member, said false twisting device, and said winder, said yarn heater and said yarn cooling member being disposed with respect to each other so as to define an elevated yarn deflection position between the outlet end of said heater and the inlet end of said cooling member, and a yarn feeding and guiding device for feeding the advancing yarn to the elevated yarn deflection position and then guiding the advancing yarn at such position and comprising a guide rail having a yarn guide which moves along said guide rail between said elevated yarn deflection position and a lower thread-up position, a drive for selectively moving the yarn guide between the elevated and lower positions, a blocking member mounted for movement between an inactive position wherein the yarn guide is free to move between the elevated and lower positions, and a blocking position wherein the blocking member is adapted to engage and hold the yarn guide at a parking position which is spaced between the elevated and lower positions, means for biasing the blocking member toward the inactive position, and a control device for, upon the occurrence of a sensed condition while the yarn guide is in its elevated position, (a) moving the blocking member from the inactive position to the blocking position, and (b) moving the yarn guide downwardly from the elevated position toward the lower position and such that the yarn guide is engaged and held at the parking position by the blocking member.

12. The yarn false twist texturing apparatus as defined in claim 11 wherein said yarn heater and said yarn cooling member are angularly disposed with respect to each other so as to define an apex at said yarn deflection position.

13. The yarn false twist texturing apparatus as defined in claim 11 wherein said control device includes a cylinder piston unit having a piston rod which is extendable and retractable and which is positioned to physically contract the blocking member and move the blocking member toward the blocking position upon being extended.

14. The yarn false twist texturing apparatus as defined in claim 13 wherein the piston rod and the blocking member includes a catch which is engaged when the piston rod is extended so as to support the blocking number in an intermediate waiting position wherein the blocking member partly protrudes into the path of the yarn guide.

15. The yarn false twist texturing apparatus as defined in claim 14 wherein the blocking member includes a stop surface positioned to be engaged by the yarn guide when the yarn moves from the upper position downwardly and the blocking member is in said waiting position, and such that the interengagement between the blocking member and the moving yarn guide causes the blocking member to further move from said waiting position to said blocking position.

16. The yarn false twist texturing apparatus as defined in claim 15 wherein said blocking member is mounted for pivotal movement about a pivot axis between said inactive and blocking positions.

17. The yarn false twist texturing apparatus as defined in claim 11 wherein the guide rail comprises a tubular sleeve, wherein the drive includes a drive piston slidably mounted in the sleeve, and an air control valve for selectively directing compressed air into the sleeve on either side of the drive piston, and wherein said yarn guide includes a sliding element which is mounted on the outside of said sleeve and which is operatively joined to the drive piston by magnetic means so as to move with the piston.

18. The yarn false twist texturing apparatus as defined in claim 17 wherein said air control valve includes a housing slidably supporting a control piston therein, and a plunger which is fixed to said control piston and extends to a location outside of said housing so as to be manually engageable.

19. A yarn false twist texturing apparatus comprising an elongate yarn heater which includes a yarn inlet end and a yarn outlet end, an elongate yarn cooling member which includes an inlet end and an outlet end, yarn false twisting device, a winder for winding an advancing yarn into a package, means for advancing a yarn serially to said heater, said cooling member, said false twisting device, and said winder, said yarn heater and said yarn cooling member being disposed with respect to each other so as to define an elevated yarn deflection position between the outlet end of said heater and the inlet end of said cooling member, and a yarn feeding and guiding device for feeding the advancing yarn to the elevated yarn deflection position and then guiding the advancing yarn at such position and comprising a guide rail having a yarn guide which moves along said guide rail between said elevated yarn deflection position and a lower thread-up position, a drive for selectively moving the yarn guide between the elevated and lower positions, and a control device for, upon the occurrence of a sensed condition while the yarn guide is in its elevated position, moving the yarn guide downwardly along said guide rail from the elevated position to a parking position located between the elevated and lower positions and just below the elevated position and holding the yarn guide at the parking position.

20. The yarn false twist texturing apparatus as defined in claim 14 wherein the guide rail comprises a tubular sleeve, wherein the drive includes a drive piston slidably mounted in the sleeve, and an air control valve for selectively directing compressed air into the sleeve on either side of the drive piston, wherein said yarn guide includes a sliding element which is mounted on the outside of said sleeve and which is operatively joined to the drive piston by magnetic means so as to move with the piston, and wherein said air control valve includes a housing slidably supporting a control piston therein, and a plunger which is fixed to said control piston and extends to a location outside of said housing so as to be manually engageable.

* * * * *

UNITED STATES PATENT AND TRADEMARK OFFICE
CERTIFICATE OF CORRECTION

PATENT NO. : 5,896,976

DATED : April 27, 1999

INVENTOR(S) : Jaschke

It is certified that error appears in the above-identified patent and that said Letters Patent is hereby corrected as shown below:

Title page, item [56]:

In the References Cited, U.S. PATENT DOCUMENTS, line 7, "Dammannn" should read --Dammann--;

FOREIGN PATENT DOCUMENTS, line 1, "Denmark" should read --Germany--.

Column 10, line 51, "claim 14" should read --claim 19--.

Signed and Sealed this

Nineteenth Day of October, 1999

*Attest:*

*Attesting Officer*

Q. TODD DICKINSON

*Acting Commissioner of Patents and Trademarks*